US009743206B2

(12) United States Patent
Clark

(10) Patent No.: US 9,743,206 B2
(45) Date of Patent: Aug. 22, 2017

(54) BACKGROUND NOISE MEASUREMENT FROM A REPEATED STIMULUS MEASUREMENT SYSTEM

(71) Applicant: Jeffrey Clark, Alhambra, CA (US)

(72) Inventor: Jeffrey Clark, Alhambra, CA (US)

(73) Assignee: AUDYSSEY LABORATORIES, INC., Los Angeles, CA (US)

( * ) Notice: Subject to any disclaimer, the term of this patent is extended or adjusted under 35 U.S.C. 154(b) by 0 days.

(21) Appl. No.: 14/746,619

(22) Filed: Jun. 22, 2015

(65) Prior Publication Data

US 2016/0373873 A1 Dec. 22, 2016

(51) Int. Cl.

| | |
|---|---|
| ***H04R 29/00*** | (2006.01) |
| ***H04R 3/04*** | (2006.01) |
| ***H04R 3/12*** | (2006.01) |
| ***H04S 7/00*** | (2006.01) |

(52) U.S. Cl.

CPC ..... *H04R 29/007* (2013.01); *H04R 3/04* (2013.01); *H04R 3/12* (2013.01); *H04S 7/305* (2013.01)

(58) Field of Classification Search

CPC ..... H04R 29/007
USPC ..... 324/616; 348/177; 361/118; 375/224, 375/350, 376; 381/56; 398/9; 455/556.1; 600/504, 544; 702/65
See application file for complete search history.

(56) References Cited

U.S. PATENT DOCUMENTS 3,939,689 A 2/1976 Desarzens
4,163,940 A 8/1979 Brewton
5,530,367 A * 6/1996 Bottman ..... G01R 27/28 324/520
5,680,420 A * 10/1997 Reime ..... H04N 5/21 348/E5.077
5,970,429 A * 10/1999 Martin ..... G01R 29/26 324/613
6,052,619 A * 4/2000 John ..... A61B 5/0476 600/544
6,385,486 B1 * 5/2002 John ..... A61B 5/0002 600/544
7,035,324 B2 * 4/2006 Mar ..... H04L 1/206 324/613
7,483,501 B1 1/2009 Michaels, Jr.
8,390,268 B2 3/2013 Okayasu
(Continued)

*Primary Examiner* — Gerald Gauthier

(74) *Attorney, Agent, or Firm* — Kenneth L. Green; Averill & Green

(57) ABSTRACT

A minimum level for a stimulation signal used in room correction processing is determined by measuring background noise. The stimulation signal is repeated a number of times and resulting responses are recorded. The recording responses are averaged, and the average is subtracted from each recorded response to obtain the background noise present in each recorded response. A stimulation signal to background noise ratio is computed from the stimulation signal and background noise and compared to an SNR threshold to determine if the stimulation signal level is sufficient to support the room correction processing. The background noise may be AC hum introduced electronically into the response signal, acoustic noise introduced by AC ventilation systems or noise emitting devices (refrigerators, etc), and it may be structure-born noise introduced by shaking the microphone, e.g. a bus drives by, shaking the floor the microphone is standing on.

20 Claims, 2 Drawing Sheets

(56) References Cited

U.S. PATENT DOCUMENTS

| | | | | |
|---|---|---|---|---|
| 2004/0077960 | A1* | 4/2004 | Tanaka | A61B 5/486 600/504 |
| 2004/0158431 | A1* | 8/2004 | Dittberner | H04R 25/30 702/183 |
| 2005/0157829 | A1* | 7/2005 | Aoyama | H03L 7/08 375/376 |
| 2006/0221531 | A1* | 10/2006 | Nagata | G01R 29/26 361/118 |
| 2008/0310836 | A1* | 12/2008 | Weckwerth | H04B 10/1143 398/9 |
| 2013/0182124 | A1* | 7/2013 | Asjadi | H04N 17/045 348/177 |
| 2015/0078226 | A1* | 3/2015 | Charlon | H04B 1/525 370/290 |
| 2015/0212112 | A1* | 7/2015 | Lai | G01R 31/2601 324/754.03 |
| 2016/0080548 | A1* | 3/2016 | Erickson | H04M 1/72527 455/556.1 |
| 2016/0373873 | A1* | 12/2016 | Clark | H04R 29/007 |

* cited by examiner

BACKGROUND NOISE MEASUREMENT FROM A REPEATED STIMULUS MEASUREMENT SYSTEM

BACKGROUND OF THE INVENTION

The present invention relates to processing to adapt audio equalization to an environment, and in particular to determining the Signal to Noise Ratio (SNR) from a measurement and ensuring that the SNR supports the audio equalization processing.

The accuracy of sound reproduction is often degraded by sound reflections from surfaces within a listening space. Methods have been developed to compensate for the effects of these sound reflections. Such methods require transmitting a test signal and measuring the resulting sound at one or more location in the listening space. Unfortunately, the ability to accurately measure the sound reflections requires a minimum SNR to distinguish the sound reflections from noise in the listening space. While it is generally possible to increase the level of the test signal, at some level, the test signal becomes objectionable to individuals in or near the listening space, or exceeds the sound level accurately produced by speakers used to generate the test signal. Thus, a method is needed to measure the background noise present in the listening space to determine an adequate level for the test signal.

Sound from different speakers may arrive at the listener at different times due to varying distances of the speakers, different electronics in the speakers or differences in the signal path, e.g., wireless links or amplifiers with different latency. The delays may be measured and compensated for to provide more accurate sound. If a minimum signal to noise ratios is not achieved, the compensation may experience reduced accuracy or fail.

Speaker sensitivities perceived at a listening position may be measured and the measurements used to adjust output trim levels to align the absolute sensitivity to a reference sensitivity from available home theater standards. If a minimum signal to noise ratios is not achieved, the alignment may experience reduced accuracy or fail.

Known methods for measuring the background noise do so separately before transmitting the test signal to measure the listening space and are slow. Such methods are not able to detect extra background noise intrusions that occur during the room measurement process.

BRIEF SUMMARY OF THE INVENTION

The present invention addresses the above and other needs by simultaneously measuring the background noise and the room response and determining if an adequate Signal to Noise Ratio (SNR) was achieved or if the test signal should be played louder to overcome the background noise. The stimulation signal is repeated a number of times and resulting responses are recorded. The recorded responses are averaged, and the average is subtracted from each recorded response to obtain a background noise present in each recorded response. A response signal to background noise ratio is computed from the recorded responses and background noise and compared to a SNR threshold to determine if the stimulation signal level is sufficient to support the room correction processing. The background noise may be AC hum introduced electronically into the response signal, acoustic noise introduced by AC ventilation systems or noise emitting devices (refrigerators, etc.), and it may be structure-born noise introduced by shaking the microphone, e.g., a bus drives by, shaking the floor the microphone is standing on.

In accordance with one aspect of the invention, there is provided a method for measuring background noise which requires less time to perform measurements and detects noise intrusions during the measurement process. The method also detects noise that is a time-variant function of the stimulus and/or response signal, but which is not considered a valid part of the measurement.

In accordance with another aspect of the invention, there is provided a method for determining a stimulus signal level to achieve adequate measurement SNR to ensure suitability for correction processing. The method includes steps of providing a stimulus signal to an audio system, converting the stimulus signal to at least one speaker signal, transducing the at least one speaker signal by at least one corresponding speaker to produce an acoustic signal in an area including background noise, recording the broadcasted acoustic signal and background noise, repeating the first four steps several times, averaging the recorded broadcasted audio signal and background noise, subtracting the average from each recording to obtain the noise for each recording, computing the RMS noise level of the noise, determining a stimulus signal level to the RMS noise level SNR level, and improving the SNR if necessary to achieve adequate SNR for the purpose of equalization processing.

In accordance with another aspect of the invention, there are provided methods for improving sound quality of an acoustic system based on noise measurements. The methods include:

Deciding whether and how much to mitigate background noise sources by disabling noise sources, or adding diffusing or absorbing devices;

Where the background noise is judged too high, switching off noise generating devices, moved noise generating devices further from the microphone, or physically damping the noise generating devices. This is warranted if the background noise is over, for example, 70 dB SPL C-weighted, since achieving a 10 dB SNR would require 80 dB SPL or more in the stimulus signal;

Improving speaker placement to address deep valleys in the frequency response which are uncorrectable by equalization; and Deciding whether or not it is worthwhile to use room treatments to mitigate coloration from reflections and diffraction, and where and how much room treatment to use (frequencies substantially cancelled by reflections or diffractions are impossible to correct with equalization, so can be dealt with by treatments. Or, frequency anomalies attributable to the ceiling reflection or back-wall reflection ("Allison dip") may be handled with absorbing or diffusing panels before room equalization using digital signal processing or electronics is performed.)

In accordance with another aspect of the invention, there is provided a method for broadcasting a stimulation signal used for room equalization processing. Examples of stimulations signals include a logarithmically swept sine (chirp) and pink noise, and signal having characteristics including: pink in spectrum; finite DC (zero Hz); spectrum covering the human audible frequency range of 20 HZ to 20 kHz (in most cases the signal covers 10 Hz to 24 kHz and a 48 kHz sampling rate); a power of two length for efficiency of FFT-based processing (RMS, filtering or otherwise); and of low peak to average (peak to RMS) ratio—large peaks in the signal will limit how loud it could play.

In accordance with still another aspect of the invention, there is provided a method for determining if a stimulus signal has sufficient signal to noise ratio to compute distances to each speaker in an audio video system. The distances may be used to compute delays to apply to each speaker so the arrival time to the listener is the same. The delays may be further used to compute appropriate delay for video/audio synchronization, so that audio signals are synchronization video signals.

In accordance with yet another aspect of the invention, there is provided a method for determining a stimulus signal level to achieve adequate measurement SNR to compute absolute sensitivities of speakers in a speaker system. The sensitivities may be used to apply output level trims to each speaker so that each speaker has the same sensitivity at the listening position. The trims are ideally calculated to aligned the absolute sensitivity to a reference sensitivity from available home theater standards.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 1:
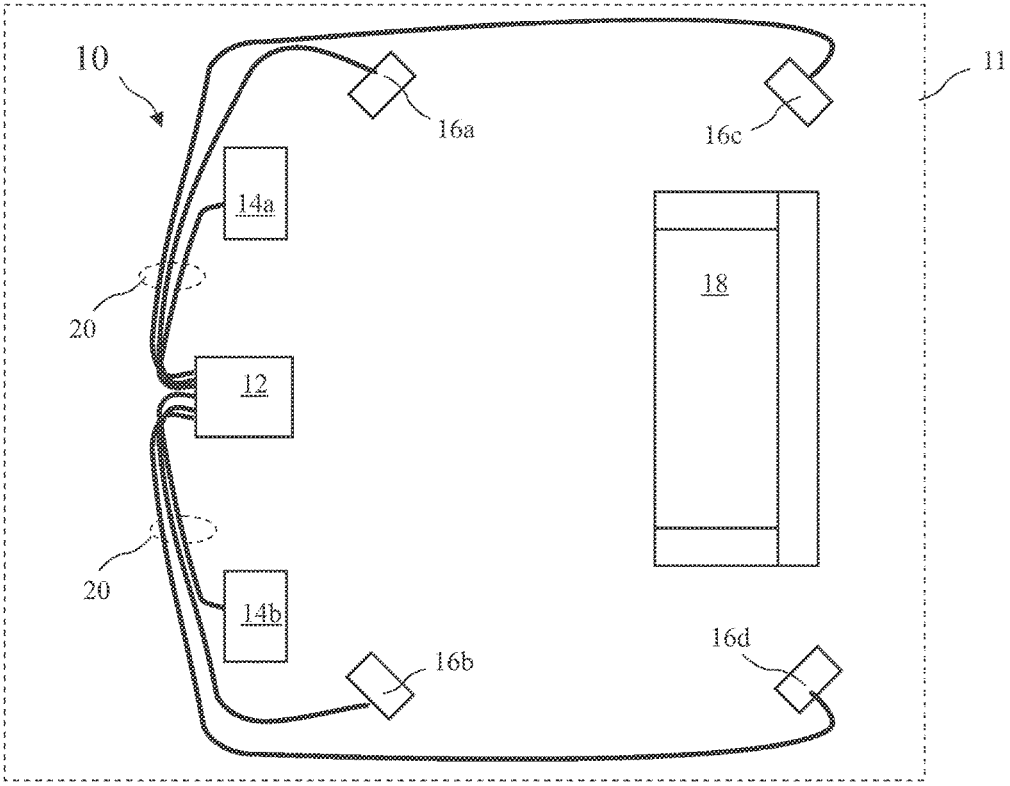
FIG. 1 shows an audio system in a listening space according to the present invention.

An audio reproduction system 10 in a listening space 11 according to the present invention is shown in FIG. 1. The audio system 10 includes a signal processor (for example an audio receiver) 12, main speakers 14*a* and 14*b*, surround speakers 16*a*, 16*b*, 16*c*, and 16*d*, and speaker cables 20. The speakers may also be wireless, for example BLUETOOTH® speakers. Seating 18 is provided for listeners. A frequency response that is judged to be within a user-determined variation, for example, the ⅓ octave smoothed response is +/−2 dB of a user-specified target frequency response without broad band discrepancies, might be considered adequate to be within calibration.

Figure 2:
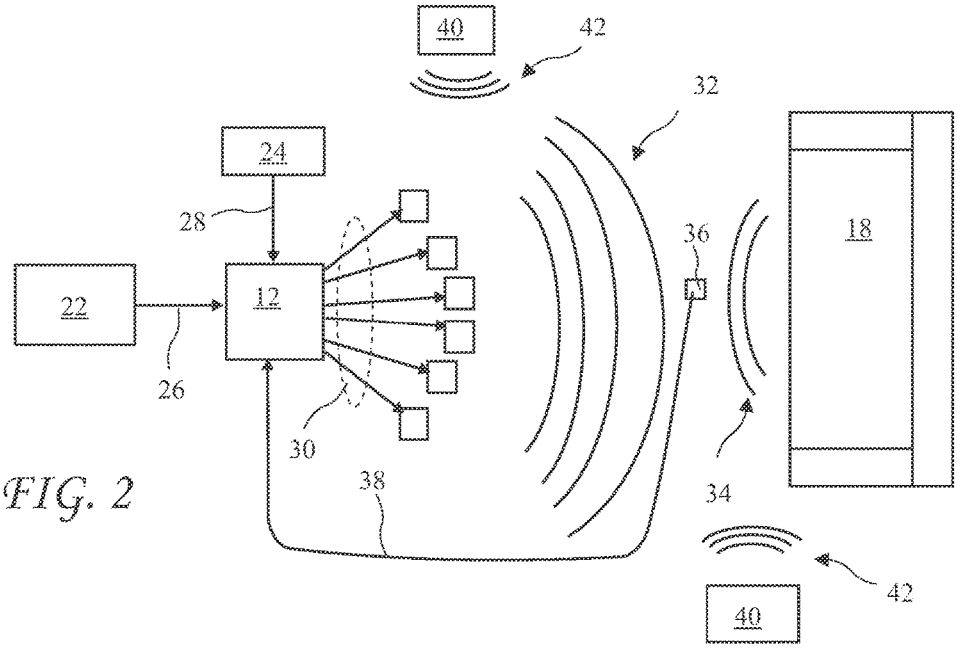
FIG. 2 shows signals flowing through the audio system and into the living space according to the present invention.

FIG. 2 shows signals flowing through the audio system 10 and into the living space 11. The signal processor 12 receives content signals 26 from a source 22 for normal operation. The receiver 12 also has a noise measurement mode wherein the receiver 12 generates a stimulation signal 30 sent to the speakers 14*a*, 14*b*, and 16*a*-16*d* creating an audio signal 32. A microphone 36 receives the audio signal 32, and also reflections 34 from objects (for example the seating 18) present in the living space 11. The microphone 36 provides a signal 38 to the signal processor 12 and the signal processor 12 performs correction processing to provide room equalization tailored to the living space 11.

In some instances, electrical noise 28, for example Alternating Current (AC) hum, may be introduced into the signal processor 12, and noise sources 40 may introduced environmental noise 42 into the living space 11. Further, vibrations in living space 11 may introduce noise into the microphone 36. If the total noise reduces the recorded response to noise ratio significantly, the measurement process may produce inaccurate results.

It is generally possible to increase the level of the stimulation signal 30 to obtain a sufficient stimulation signal 30 to noise ratio, however, an arbitrarily high level for the stimulation signal 30 may annoy listeners or bystanders. Further, an arbitrarily high stimulation signal 30 may cause one or more of the speakers 14*a*, 14*b*, and 16*a*-16*d* to distort the stimulation signal 30 causing the correction processing to fail.

Figure 3:
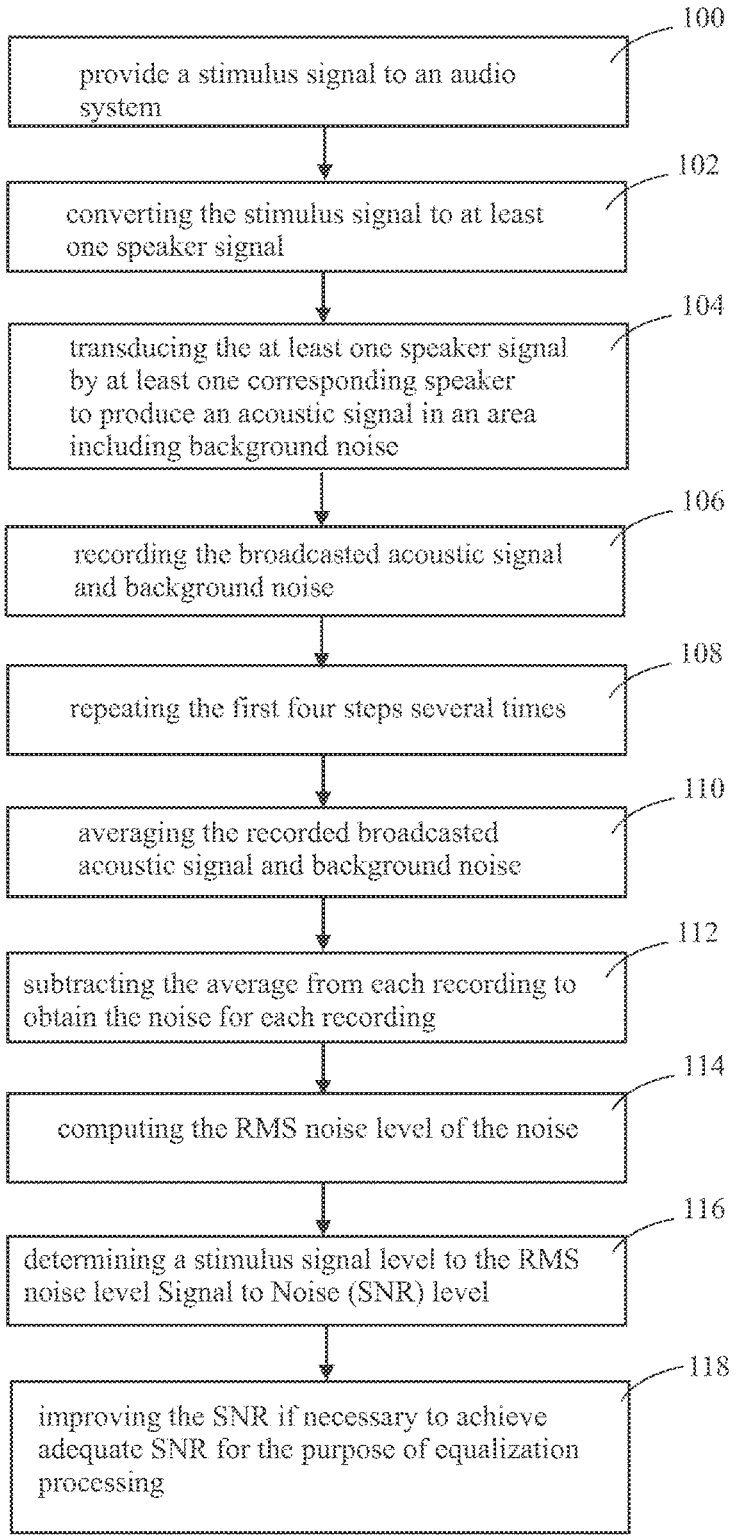
FIG. 3 shows a method for measuring background noise in the living space according to the present invention.

A method for measuring background noise in the living space 11 is described in FIG. 3. The method includes providing a stimulus signal to an audio system at step 100, converting the stimulus signal to at least one speaker signal at step 102, transducing the at least one speaker signal by at least one corresponding speaker to produce an acoustic signal in an area including background noise at step 104, recording the broadcasted acoustic signal and background noise at step 106, repeating the first four steps several times at step 108, averaging the recorded broadcasted audio signal and background noise at step 110, subtracting the average from each recording to obtain the noise for each recording at step 112, computing the RMS noise level of the noise at step 114, determining a stimulus signal level to the RMS noise level Signal to Noise (SNR) level at step 116, and increasing the SNR if necessary to achieve adequate SNR for the purpose of equalization processing at step 118.

The SNR may be increased by increasing the stimulation signal level or by reducing noise sources in the test environment. Examples of ways to reduce noise levels include disabling noise making appliances such as refrigerators or air conditioner; performing the measurement during low traffic times; reducing noise from human and animal sources; and stabilizing the microphone stand with additional weight on the legs or body of the stand.

After improving the SNR, room equalization may be performed using the steps of: performing the equalization processing; determining room equalization; applying the room equalization to an electrical signal; and transducing the equalized signal to an audio signal. Processing audio signals to synchronize audio signals, and to compensate for speaker sensitivity, also requires a minimum SNR, and the method of FIG. 3 may also be applied to ensure stimulation signals have the minimum SNR required for such synchronization and sensitivity processing.

A second method according to the present invention includes the steps of: providing a stimulus signal to a system including a transducer, converting the stimulus signal to at least one electro mechanical transducer signal, transducing the at least one electro mechanical transducer signal by the transducer to produce a physical output in an environment including background noise, receiving the physical output and background noise by a second transducer, recording the received physical output and background noise, repeating the first four steps several times, averaging the recordings, subtracting the average from each recording to obtain a noise measurement for each recording, determining a Signal to Noise Ratio (SNR) of system using the noise measurement, determining if the SNR is sufficient to ensure accuracy of the physical output produced by the system, improve the SNR of the system from the stimulus signal input to the transducer if necessary to provide a sufficiently accurate physical signal, processing the sufficiently accurate physical signal recording to determine changes to the system which will provide improved physical outputs of the system, implementing the changes in the system, and processing input signals by the system to produce improved physical outputs. A physical transducer may be, for example, an audio speaker, a mechanical device such as a motor, an antenna that transduces an electrical signal in wires to electromagnetic waves, or any device which received an electrical signal and changes the form of the signal.

A third method according to the present invention includes the steps of: providing a stimulus signal to an audio system; converting the stimulus signal to at least one speaker signal; broadcasting the at least one speaker signal from a corresponding speaker to produce an audio signal in an area including background noise; recording the broadcasted audio signal and background noise; repeating the first four steps several times; averaging the recordings of the broadcasted audio signal and background noise; subtracting the average from each recording to obtain a noise measurement for each recording; computing an RMS noise level of the noise measurements; determining a stimulus signal level to the RMS noise level Signal to Noise level (SNR); improving the SNR if necessary to achieve a minimum SNR to ensure accuracy of signal correction processing; transmitting the stimulus signal having adequate SNR; determining the signal correction processing based on the transmitted stimulation signal; applying the signal correction processing to an electrical signal; providing the corrected electrical signal to a transducer; and transducing the corrected electrical signal to a mechanical operation.

Preferably, the recording periods are contiguous (without spacing), or the recording periods includes sufficient additional time after the stimulus signal is played to include any longer reverberations in the area. In the case that the stimulus signals are repeated contiguously, the first one or more signal recordings (enough time sufficient to exceed the reverberation ring-down time of the system/room), are preferably discarded and only the following signals are averaged.

The stimulation signal is composed of frequencies periodic in the length of a single repetition of the stimulation signal. The RMS noise level is preferably the RMS average of the noise in several different ranges of the frequency spectrum. The RMS average is obtained by band-pass filtering the time-domain signal and then taking the RMS. The RMS average may also be accomplished by taking the frequency domain magnitude of the noise and applying a frequency magnitude weighting, and taking the RMS. The RMS values may be scaled based on the number of repetitions of the stimulus signal. For example, eight repetitions of the stimulus signal are used, then ⅞ of the noise present may be measured. The remaining ⅛ of the noise is inseparable from the signal.

While a stimulation signal for room equalization is discussed above, those skilled in the are will recognize that other causes of signal degradation may be addressed using corresponding stimulation signals and processing. For example, time response; distance (delay/synchronization); level (trim to relative consistent level or to an absolute system sensitivity); distortion; harmonic distortion; and maximum sound level. Systems according to the present invention addressing these other forms of signal degradation are intended to come within the scope of the present invention.

Further, various improvements may be to improve SNR. For example, improve the performance of the physical transducer (e.g., replace the speaker); improve the operating environment of the physical transducer that degrades its output (e.g. room acoustic treatment); improve the quality of digital signal processing in a digital system to reduce signal degradation before it is transduced (e.g., filtering algorithms); improve the quality of electronics that convey the signal through the system (e.g. amplifier); and improve the quality of signal transmission to the physical transducer (e.g. wiring). Such improvements are intended to come within the scope of the present invention.

While the invention herein disclosed has been described by means of specific embodiments and applications thereof, numerous modifications and variations could be made thereto by those skilled in the art without departing from the scope of the invention set forth in the claims.

I claim:

1. A method for providing an adequate signal level in the presence of noise, comprising:

providing a stimulus signal to a system including a signal processor and a transducer;

converting the stimulus signal to at least one electro mechanical transducer signal by the signal processor;

transducing the at least one electro mechanical transducer signal by the transducer to produce a physical output in an environment including background noise;

receiving the physical output and background noise by a second transducer;

recording the received physical output and background noise;

repeating the first five steps at least two times;

averaging the recordings by the signal processor;

subtracting the average from each recording to obtain a noise measurement for each recording by the signal processor;

determining a Signal to Noise Ratio (SNR) of the stimulus signal to the noise measurements by the signal processor;

improve the SNR of the system from the stimulus signal input to the transducer if necessary to ensure accuracy of processing selected from the group consisting of:

performing equalization processing;

adjustment of output trim levels to align the absolute sensitivity to a reference sensitivity from available home theater standards;

measuring delays due to varying distances of the speakers, different electronics in the speakers or differences in the signal path and compensated for the delays to provide more accurate sound;

distinguishing sound reflections from noise in the listening space to compensate for the effects of the sound reflections;

detecting noise that is a time-variant function of the stimulus and/or response signal, but which is not a valid part of the measurement;

computing distances to each speaker in an audio video system;

computing appropriate delay for video/audio synchronization, so that audio signals are synchronization video signals; and computing absolute sensitivities of speakers in a speaker system;

processing the physical signal recording by the signal processor to determine changes to the system which will provide improved physical outputs of the system;

implementing the changes in the system;

processing input signals by the signal processor to produce improved signals; and a speaker transducing the improved signals to produce sound waves.

2. The method of claim 1, wherein improving the SNR comprises increasing the level of the stimulation signal.

3. The method of claim 1, wherein improving the SNR comprises disabling noise making appliances.

4. The method of claim 1, wherein improving the SNR comprises performing the measurement when background noise is lower.

5. The method of claim 1, wherein improving the SNR comprises stabilizing the second transducer used to record the physical output and the background noise.

6. The method of claim 1, wherein the stimulus signal is designed for measuring complex frequency response of an audio reproduction system.

7. The method of claim 6, wherein the measured complex frequency response is used to determine changes to signal processing to improve at least one of a frequency response and a time response of the reproduction system.

8. The method of claim 6, wherein the measured complex frequency response is used to determine changes to signal processing to compensate for different times required for audio signals from each of at least two speakers to reach a listening position.

9. The method of claim 6, wherein the measured complex frequency response is used to determine changes to signal processing to compensate for different audio signal levels from each of at least two speakers perceived at a listening position.

10. The method of claim 1, wherein the stimulus signals are contiguous.

11. The method of claim 1, wherein the SNR is computed using an RMS noise levels taken over a portion of a frequency spectrum by band-pass filtering.

12. The method of claim 1, wherein the SNR is computed using an RMS noise levels are taken over a portion of the frequency spectrum using a subset of frequency response values from an FFT of the measurement.

13. A method for determining a stimulus signal level for correction processing, comprising:

providing a stimulus signal to a signal processor in an audio system;

converting the stimulus signal to at least one speaker signal;

broadcasting the at least one speaker signal from a corresponding speaker to produce an audio signal in an area including background noise;

recording the broadcasted audio signal and background noise;

repeating the first four steps at least two times utilizing contiguous stimulation signals;

averaging the recordings of the broadcasted audio signal and background noise;

subtracting the average from each recording to obtain a noise measurement for each recording;

computing a noise level of the noise measurements;

determining a stimulus signal level to the noise level Signal to Noise Ratio (SNR);

improving the SNR if necessary to achieve a minimum SNR to ensure accuracy of signal correction processing;

re-transmitting the stimulus signal;

determining the signal correction processing based on the transmitted stimulation signal;

applying the signal correction processing by the signal processor to an electrical signal to produce a corrected signal;

providing the corrected electrical signal to a transducer; and the speaker transducing the corrected electrical signal into sound waves.

14. The method of claim 13, wherein the noise levels are taken over a portion of a frequency spectrum by band-pass filtering.

15. The method of claim 13, wherein the noise levels are taken over a portion of the frequency spectrum using a subset of frequency response values from an FFT of the measurement.

16. A method for audio system equalization, comprising:

providing a stimulus signal to an audio system including a processor;

converting the stimulus signal to at least one speaker signal by the processor;

transducing the at least one speaker signal by at least one corresponding speaker to produce an acoustic signal in an area including background noise;

recording the broadcasted acoustic signal and background noise by a microphone;

repeating the first four steps at least two times utilizing contiguous stimulation signals;

averaging the recorded broadcasted audio signal and background noise;

subtracting the average of the broadcasted audio signal from each recording to obtain the noise for each recording;

computing a Root Mean Squared (RMS) noise level of the noise;

determining a Signal to Noise Ratio (SNR) of system using the RMS noise level;

improving the SNR of the system if necessary to obtain a sufficiently accurate recording to perform room equalization processing;

producing the sufficiently accurate recording;

processing the sufficiently accurate recording to determine room equalization processing;

applying the room equalization processing to one of an analog or digital electrical signal to produce an equalized signal by the processor; and the speaker transducing the equalized signal to sound waves.

17. The method of claim 16, wherein improving the SNR comprises increasing the level of the stimulation signal.

18. The method of claim 16, wherein improving the SNR comprises disabling noise making appliances.

19. The method of claim 16, wherein improving the SNR comprises performing the measurement during low traffic times.

20. The method of claim 16, wherein improving the SNR comprises stabilizing a microphone used to record the physical output and the background noise.

* * * * *